US010287840B2

(12) United States Patent
Strand et al.

(10) Patent No.: US 10,287,840 B2
(45) Date of Patent: May 14, 2019

(54) ARRANGEMENT FOR SUPPORTING A WELLHEAD

(71) Applicant: NeoDrill AS, Ålgard (NO)

(72) Inventors: Harald Strand, Ålgard (NO); Wolfgang Mathis, Sandnes (NO)

(73) Assignee: NeoDrill AS, Ålgard (NO)

( * ) Notice: Subject to any disclaimer, the term of this patent is extended or adjusted under 35 U.S.C. 154(b) by 0 days.

(21) Appl. No.: 15/522,518

(22) PCT Filed: Nov. 25, 2015

(86) PCT No.: PCT/NO2015/050222
§ 371 (c)(1),
(2) Date: Apr. 27, 2017

(87) PCT Pub. No.: WO2016/085348
PCT Pub. Date: Jun. 2, 2016

(65) Prior Publication Data

US 2017/0356265 A1 Dec. 14, 2017

(30) Foreign Application Priority Data

Nov. 27, 2014 (NO) ..... 20141427

(51) Int. Cl.
*E21B 43/10* (2006.01)
*E21B 33/035* (2006.01)
*E21B 33/043* (2006.01)

(52) U.S. Cl.
CPC ..... *E21B 33/043* (2013.01); *E21B 33/035* (2013.01); *E21B 43/101* (2013.01)

(58) Field of Classification Search
CPC ..... E21B 33/043; E21B 33/035; E21B 33/03; E21B 43/101
See application file for complete search history.

(56) References Cited

U.S. PATENT DOCUMENTS 4,260,289 A 4/1981 Moinard
4,558,973 A 12/1985 Blandford
(Continued)

FOREIGN PATENT DOCUMENTS

NO 305179 4/1999
NO 313340 8/2001
(Continued)

OTHER PUBLICATIONS

Norwegian Search Report, Norwegian Patent Application No. 20141427, dated Jun. 27, 2015.
(Continued)

*Primary Examiner* — James G Sayre
(74) *Attorney, Agent, or Firm* — Andrus Intellectual Property Law, LLP

(57) ABSTRACT

A device is for reducing the load on a wellhead casing from a bending moment generated by a horizontal load component from a well element arranged over a wellhead. A supporting frame is connected to an upper portion of the wellhead casing and projects outwards from the center axis of the wellhead casing and is provided with an abutment which rests supportingly against a base at a radial distance from the wellhead casing. The supporting frame is arranged to absorb a portion of said bending moment.

21 Claims, 2 Drawing Sheets

(56) References Cited

U.S. PATENT DOCUMENTS

| | | | | |
|---|---|---|---|---|
| 6,209,650 | B1 * | 4/2001 | Ingebrigtsen | E21B 33/038 166/345 |
| 6,220,303 | B1 * | 4/2001 | Secher | E21B 17/017 138/109 |
| 9,140,105 | B2 * | 9/2015 | Pattillo | E21B 43/10 |
| 2006/0162933 | A1 | 7/2006 | Millheim et al. | |
| 2010/0212916 | A1 * | 8/2010 | Rice | E21B 33/03 166/379 |
| 2011/0048727 | A1 * | 3/2011 | Carlsen | E21B 17/017 166/345 |
| 2011/0178730 | A1 * | 7/2011 | Mangal | E21B 17/017 702/43 |
| 2014/0374116 | A1 * | 12/2014 | Kelso | E21B 33/035 166/345 |

FOREIGN PATENT DOCUMENTS

| | | | |
|---|---|---|---|
| NO | 331978 | 12/2011 | |
| WO | 2011/018120 | 2/2011 | |
| WO | 2011/162616 | 12/2011 | |
| WO | WO 2012/049289 A1 * | 4/2012 | E21B 33/035 |
| WO | 2014/210017 | 12/2014 | |

OTHER PUBLICATIONS

International Search Report, PCT/NO2015/050222, dated Feb. 16, 2016.
Written Opinion, PCT/NO2015/050222, dated Feb. 16, 2016.
Written Opinion, PCT/NO2015/050222, dated Aug. 12, 2016.
Written Opinion, PCT/NO2015/050222, dated Oct. 20, 2016.
International Preliminary Report on Patentability, PCT/NO2015/050222, dated Jan. 23, 2017.
Dahl Lien: "Methods to Improve Subsea Wellhead Fatigue Life", Faculty for Engineering and Technology, Institute for Petroleium Technology and Applied Geophysics, NTNU, Trondheim, Norway, dated Dec. 17, 2009, 48 pages.
Oslo District Court Ruling dated Jun. 21, 2018, with English translation of pertinent pp. 68-83.

* cited by examiner

ARRANGEMENT FOR SUPPORTING A WELLHEAD

CROSS-REFERENCE TO RELATED APPLICATIONS

This application is the U.S. national stage application of International Application PCT/NO2015/050222, filed Nov. 25, 2015, which international application was published on Jun. 2, 2016, as International Publication WO 2016/085348 in the English language. The International Application claims priority of Norwegian Patent Application No. 20141427, filed Nov. 27, 2014. The international application and Norwegian application are both incorporated herein by reference, in entirety.

FIELD

The invention relates to a device for reducing the strain on a wellhead casing from a bending moment generated by a horizontal load component from a well element arranged over a wellhead.

BACKGROUND

As a rule, installing elements on a wellhead, in particular a blowout preventer (BOP), at the top of a wellhead casing which extends down through unconsolidated masses in the sea floor, usually with an upper wellhead-casing portion surrounded by and fixed to a conductor casing, involves a risk of fatiguing the wellhead casing, by the wellhead being subjected to lateral forces so that the wellhead casing is being bent. The lateral load may arise in consequence of drift of a riser extending through the water masses from the wellhead upwards to a surface installation. When a blowout preventer weighs 250-500 tonnes and has a vertical extent of up to 14-16 meters and a horizontal extent of 5-6 meters, such a bending strain will increase in that the load that is resting on the wellhead casing will have its center of gravity displaced away from the original, vertical center axis of the wellhead. The problem is described among other things by Dahl Lien: "Methods to Improve Subsea Wellhead Fatigue Life", a project assignment at the Faculty for engineering science and technology, the Institute for petroleum technology and applied geophysics, NTNU, Trondheim, Norway, 2009. The situation may lead to deformation of the wellhead casing and, at worst, fatigue and rupturing. The problems intensify as the safety requirements are being increased, for example illustrated by the fact that while pressure barriers were earlier dimensioned to withstand 5000 psi, the requirements have gradually increased to 15000 psi, and associated valves have gone from 4 to 6 levels. The use of deep-water rigs with heavy subsurface safety equipment at moderate water depths has further intensified the problems. It has been recorded that the wellhead has been subjected to strains of up to 90% of the critical limit of the wellhead as regards fatigue.

From the prior art describing solutions to the problem of fatiguing the wellhead casing which forms the foundation for wellhead elements, the inventor's own suction foundation (Conductor Anchor Node=CAN) may be mentioned, disclosed in NO patent No. 313340, included in its entirety herein by reference, in principle providing a larger contact surface between the upper part of the conductor casing and the surrounding seabed mass, the diameter of the suction foundation typically being approximately 6 meters, whereas the diameter of the conductor casing is in the range of 0.75-0.90 m (30-36 inches).

It is also known (Dahl Lien 2009, see above) to use moorings extending at outward and downward angles from an upper portion of a wellhead installation to the seabed where the moorings are secured to anchors.

From NO 305179, a suction anchor enclosing an upper portion of a conductor casing and parts of a wellhead is known. To the wellhead, a frame is connected, arranged to carry a swivel device for the horizontal connection of a riser et cetera, the frame resting on separate suction anchors placed at a distance from the former suction anchor.

From the applicant's own NO patent 331978 (and the corresponding WO publication 2011162616 A1), a stabilizing device for a wellhead with the upper portion of a wellhead casing projecting up above a seabed is known, in which a wellhead valve which projects up from the upper portion of the wellhead casing is completely or partially supported on the suction foundation by several supporting elements being arranged between the wellhead valve and the suction foundation.

US2006162933A1 discloses a system and a method of establishing a subsea exploration and production system, in which a well casing, projecting up from a seabed where a well is to be stablished, is provided with a buoyancy body arranged at a distance above the seabed. The buoyancy body is stabilized by means of adjustable stabilizing elements, which are anchored to the seabed at a distance from the well casing.

US2010/0212916 A1 is disclosing a stabilizer for a wellhead, comprising: a ground engaging support structure having lateral dimensions suitable for laterally stabilizing the wellhead; wellhead stabilizer elements disposed within the ground engaging support structure, the wellhead stabilizer elements having wellhead abutting faces spaced to laterally cage the wellhead to restrict lateral movement of the wellhead while permitting the wellhead to move in a vertical direction. The wellhead may include various wellhead components, including for example casing bowls, spools, blowout preventers, and other suitable components. The portion of wellhead that is laterally caged need not be circular in cross-section, but may be a suitable geometry.

To try to meet the constantly increasing challenges when it comes to avoiding fatigue fracturing of the wellhead, the dimension of the wellhead casing has gradually been increased, the diameter having increased from 30 inches to 36 inches and further to 42 inches, with a wall thickness that has increased from 1 inch all the way up to 2 inches.

In the further description, the term "wellhead valve" covers both a blowout preventer (BOP) alone and also a combination of a blowout preventer and other valve types (for example production valves), and other valve types or combinations of valve types alone, said wellhead valve being arranged on a wellhead on an end portion of a wellhead casing projecting above a seabed.

SUMMARY

The invention has for its object to remedy or reduce at least one of the drawbacks of the prior art or at least provide a useful alternative to the prior art.

The object is achieved through the features, which are specified in the description below and in the claims that follow.

The invention provides a method and a device for reducing the risk of fatigue in a wellhead without increasing the pipe dimension, that is to say the pipe-wall thickness, the pipe diameter or the material quality, of the wellhead casing projecting up above the seabed and forming the wellhead, and without intervening in valves and so on mounted on the wellhead. The invention involves having a supporting frame, which, at a distance from the well center, is supported on a foundation that rests on a seabed, rigidly connected to the wellhead casing to absorb a substantial portion of a bending moment applied to the wellhead casing by a horizontal load component. Calculations show that the bending stresses on the wellhead casing can be reduced considerably by the supporting frame absorbing a substantial part of the load caused by horizontal load components affecting the wellhead. Such horizontal load components may, for example, be caused by a connected riser being bent out sideways, for example because of sea currents. Studies have shown that bending stresses on the wellhead casing can be reduced to a range of 5-25% of the total torque by the supporting frame relieving the wellhead casing. The material stresses in the wellhead casing will thereby be reduced correspondingly and, with a view to fatigue, the lifetime of the wellhead casing will increase. With a conservatively estimated effect by which the load on the wellhead casing is reduced to 10%, the supporting frame taking 90% of the load, the stresses in the wellhead casing will be reduced to 10%, which results in an increase in the estimated lifetime of the wellhead casing by 1000 times seen in relation to fatigue.

The invention is defined by the independent claim. The dependent claims define advantageous embodiments of the invention.

The invention relates, more specifically, to a device for reducing the strain on a wellhead casing from a bending moment generated by a horizontal load component from a well element arranged over a wellhead, characterized by a supporting frame being connected to an upper portion of the wellhead casing and projecting outwards from the center axis of the wellhead casing and being provided with abutments resting in a supporting manner on a base at a radial distance from the wellhead casing, the supporting frame being arranged to absorb a portion of said bending moment.

The supporting frame may include a well-casing extension adapted for connection to the wellhead casing. The advantage of this is that the wellhead casing can thereby be protected from bending stresses from drilling operations during the establishing of the well, as, in this phase, the bending moment from a blowout valve and other elements temporarily installed over the wellhead subject only the supporting frame and the well-casing extension to strain, and this is removed after the drilling operations have been carried out, and the well casing is possibly provided with a new supporting frame connected directly to the wellhead casing.

The ratio of the maximum bending moment absorbed by the supporting frame to the bending moment applied to the wellhead casing may be at least 1:2, alternatively at least 3:4, alternatively at least 9:10.

The connection between the supporting frame and the wellhead casing, possibly between the supporting frame and the well-casing extension may be formed as a zero-clearance connection. An advantage of this is that any bending moment applied will, in the main, be absorbed immediately by the supporting frame.

The supporting frame may include a coupling formed as a sleeve enclosing a portion of the wellhead casing or the well-casing extension, by a press fit. The sleeve may have been shrunk around a portion of the wellhead casing or the well-casing extension. An advantage of this is that the connection can be machined with moderate requirements of tolerance, and the shrinking may be provided by heat development during the welding-together of the sleeve and the projecting elements of the supporting frame.

The base may be a seabed or a wellhead foundation. The advantage of this is that the supporting frame may be placed on the type of base that is the most suitable in each situation.

BRIEF DESCRIPTION OF THE DRAWINGS

In what follows, an example of preferred embodiments is described, which is visualized in the accompanying drawings, in which.

DETAILED DESCRIPTION OF THE DRAWINGS

Figure 1:
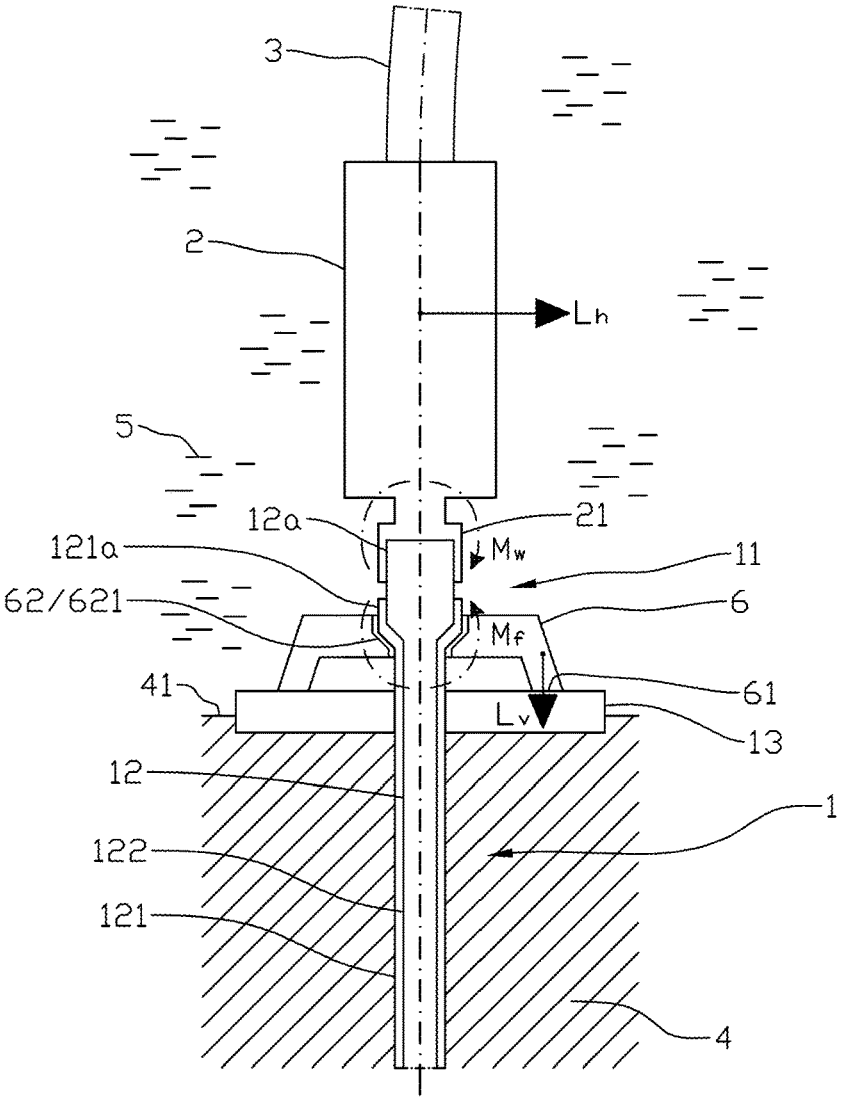
FIG. 1 shows a principle drawing of a wellhead provided with a supporting frame directly connected to an upper portion of a wellhead casing.

Reference is first made to FIG. 1. A subsea well 1 extends downwards in an underground 4 under a water mass 5. A wellhead 11 is arranged immediately above a seabed 41, an upper portion 12*a* of a wellhead casing 12 projecting up from the seabed and forming the wellhead 11 in which one or more wellhead elements 2 are arranged, at least a Christmas tree including a blowout preventer (also referred to as a BOP), a wellhead connector 21 connecting the wellhead elements 2 to the wellhead casing 12. From the wellhead element 2, at least a marine riser 3 extends up through the water mass 5 to a surface installation (not shown). The riser 3 is shown as being deflected in order to indicate a situation in which the wellhead 11 is subjected to a horizontal load component $L_h$ which subjects the wellhead casing 12 to a bending moment $M_w$. The deflection of the riser 3 may be due to currents in the water mass 5 or the position of the surface installation not shown. Currents in the water mass 5 may also subject the wellhead element 2 to a horizontal load component $L_h$, and skewed distribution of the mass of the wellhead element 2 will also subject the wellhead 11 to a horizontal load component $L_h$.

The wellhead casing 12 is shown here as a casing 122 extending up through a so-called conductor casing 121 which bounds the well 1 in a manner known per se towards the unconsolidated masses in the upper part of the base 4. An upper portion 12*a* of the wellhead casing 12 is rising from an upper portion 121*a* of the conductor casing 121.

Connected to the upper portion 12*a* of the wellhead casing 12, there is a supporting frame 6 which projects radially outwards from the wellhead casing 12 and is provided with several abutments 61 resting in a supporting manner on a base 13 shown schematically here as an element which is partially embedded in the seabed 41. The base 13 may be any wellhead foundation, for example a suction foundation or a well frame which provides a sufficiently large degree of stability and ability to absorb a load $L_v$ which is transmitted through the supporting frame 6.

The wellhead casing 12 and the supporting frame 6 are connected to each other in a way that makes it possible for the supporting frame 6 to absorb a bending moment $M_f$ as a reaction to the horizontal load component $L_h$ from the wellhead element 2 subjecting the wellhead casing 12 to said bending moment $M_w$. A coupling 62 may be arranged in such a way that the wellhead casing 12 is allowed a certain deflection before hitting the supporting frame 6 and the further load being substantially absorbed by the supporting frame 6. The design of the coupling 62 and the dimensioning of the supporting frame 6 can thereby be used to control how great a load the wellhead casing 12 may be subjected to. Calculations carried out by the applicant and other instances have shown that the supporting frame 6 may absorb 75 to 95% of the strain caused by said horizontal load component $L_h$.

To ensure a greatest possible relief of the wellhead casing 12, the coupling 62 is advantageously formed as a sleeve 621 surrounding a portion of the wellhead casing 12 without radial clearance. This is advantageously achieved by shrinking the sleeve 621.

The supporting frame 6 according to FIG. 1 is suitable for permanent installation on the wellhead 11.

Figure 3:
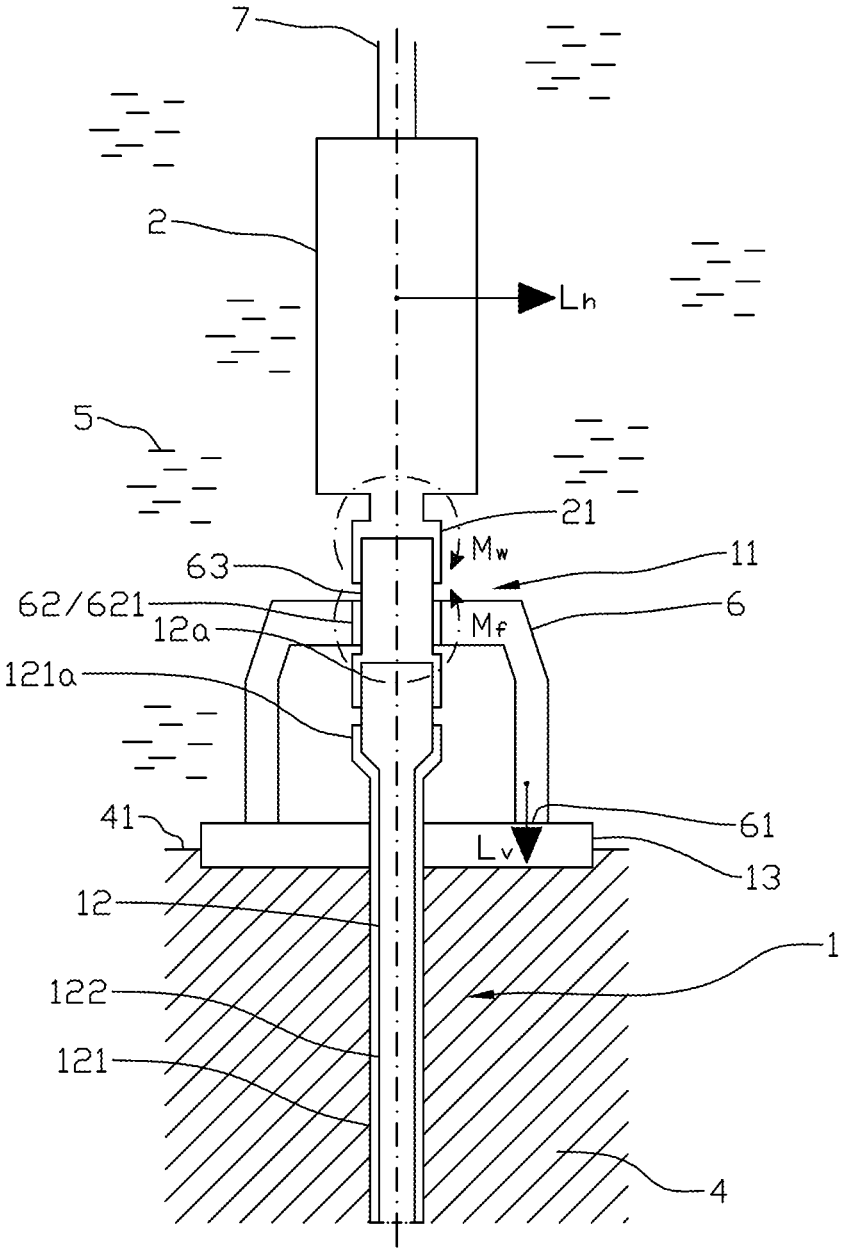
FIG. 3 shows a principle drawing of a wellhead provided with a supporting frame connected to an upper portion of a wellhead casing via a well-casing extension integrated in the supporting frame.

Reference is now made to FIG. 3, in which the supporting frame 6 is provided with a well-casing extension 63 which is adapted for insertion between the wellhead casing 12 and the wellhead element 2. Thereby the supporting frame 6 can be installed without any intervention into the wellhead casing 12. This embodiment is well suited for temporary installation, for example while drilling is in progress, indicated here by a drill string 7 extending from a surface installation not shown and through the wellhead 11. The well-casing extension 63 also works as a protection of the wellhead 11 during the temporary installation of wellhead elements 2 or the insertion or withdrawal of drilling equipment.

Figure 2:
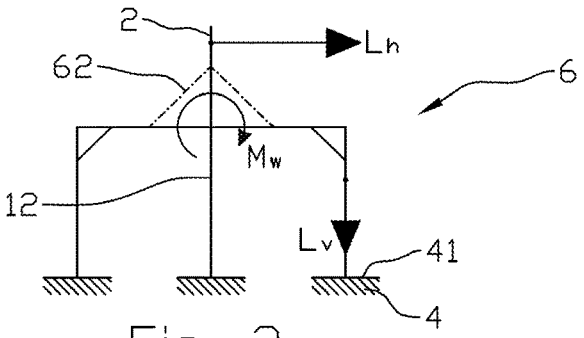
FIG. 2 shows, in a highly simplified manner, the elements that absorb load when a wellhead is subjected to a bending moment from a horizontal load component.

FIG. 2 shows the statics of the supporting frame 6 in principle. Solid, oblique connecting lines between horizontal and vertical lines indicate that the connection is rigid. Broken, oblique connecting lines indicate that the connection can allow a restricted relative movement, as is described for the coupling 62 above.

When the supporting frame 6 is mounted on the wellhead 11 and the wellhead 11 is subjected to a bending moment $M_w$ generated by a horizontal load component $L_n$ from above-lying elements 2, 3, the supporting frame 6 is subjected to a vertical load $L_v$ which is transmitted to the seabed 41 at a distance from the center axis of the wellhead casing 12 through the abutment of the supporting frame 6 against the base. Depending on the amount of play the coupling 62 between the supporting frame 6 and the wellhead casing 12 allows and how great a bending stiffness the wellhead casing 12 and the supporting frame 6 exhibit, the portion of the applied bending moment $M_w$ absorbed by the supporting frame, that is to say $M_f/M_w$, $M_f$ being the bending moment absorbed by the supporting frame 6, will vary. Calculations show that it is quite possible to dimension the supporting frame 6 to enable absorption of at least 9/10 of the bending moment $M_w$ applied.

It should be noted that all the above-mentioned embodiments illustrate the invention, but do not limit it, and persons skilled in the art may construct many alternative embodiments without departing from the scope of the dependent claims. In the claims, reference numbers in brackets should not be regarded as restrictive. The use of the verb "to comprise" and its different forms does not exclude the presence of elements or steps that are not mentioned in the claims. The indefinite article "a" or "an" before an element does not exclude the presence of several such elements.

The fact that some features are stated in mutually different dependent claims does not indicate that a combination of these features cannot be used with advantage.

The invention claimed is:

1. A device for reducing the load on a subsea wellhead casing from a bending moment generated by a horizontal load component from a wellhead element arranged over a wellhead, wherein a supporting frame is connected to an upper portion of the wellhead casing and projects outwards from the center axis of the wellhead casing and is provided with abutments which rest supportingly against a base in the form of a suction foundation and at a radial distance from the wellhead casing, the supporting frame being configured to absorb a portion of the bending moment, the wellhead casing extending through the suction foundation.

2. The device according to claim 1, wherein the supporting frame comprises a well-casing extension adapted for connection to the wellhead casing.

3. The device according to claim 2, wherein the connection between the supporting frame and the wellhead casing, or between the supporting frame and the well-casing extension is formed as a zero-clearance connection.

4. The device according to claim 3, wherein the supporting frame comprises a coupling formed as a sleeve which encloses a portion of the wellhead casing with a press fit.

5. The device according to claim 3, wherein the supporting frame comprises a coupling formed as a sleeve which encloses a portion of the well-casing extension with a press fit.

6. The device according to claim 3, wherein the supporting frame comprises a coupling formed as a sleeve which has been shrunk around a portion of the wellhead casing.

7. The device according to claim 3, wherein the supporting frame comprises a coupling formed as a sleeve which has been shrunk around a portion of the well-casing extension.

8. The device according to claim 1, wherein the ratio of the maximum bending moment absorbed in the supporting frame to the bending moment applied to the wellhead casing is at least 1:2.

9. The device according to claim 1, wherein the ratio of the maximum bending moment absorbed by the supporting frame to the bending moment applied to the wellhead casing is at least 3:4.

10. The device according to claim 1, wherein the ratio of the maximum bending moment absorbed in the supporting frame to the bending moment applied to the wellhead casing is at least 9:10.

11. The device according to claim 1, wherein the upper portion of the wellhead casing is formed with a diameter which is larger than a diameter of a remainder of the well casing extending through the base.

12. The device according to claim 1, wherein the fixed contact surfaces of the support structure are configured to engage at least a conical lower end of the upper portion of the wellhead casing.

13. The device according to claim 1, wherein a subsea well extends downwardly in an underground positioned beneath a water mass in which the wellhead element, the upper portion of the wellhead casing, the supporting frame and the base are located, the wellhead being subject to the horizontal load component due to currents in the water mass.

14. The device according to claim 1, wherein the device includes a coupling formed as a sleeve, wherein the sleeve is positioned between the supporting frame and the upper portion of the wellhead casing, and wherein the coupling is configured to allow an amount of deflection of the wellhead casing from the bending moment before the wellhead casing contacts the supporting frame.

15. The device according to claim 14, wherein the sleeve encloses the upper portion of the wellhead casing.

16. The device according to claim 15, wherein the sleeve comprises a resilient material.

17. The device according to claim 14, wherein the sleeve is shrunken around the upper portion of the wellhead casing to provide zero clearance therebetween.

18. A device for reducing the load on a subsea wellhead casing from a bending moment generated by a horizontal load component from a wellhead element arranged over a wellhead on the well casing, wherein a supporting frame is operatively connected to an upper portion of the wellhead casing and projects outwards from a center axis of the wellhead casing and is provided with abutments which rest against a base in the form of a suction foundation and at a radial distance from the wellhead casing, the supporting frame being configured to absorb a portion of the bending moment, and wherein the supporting frame is formed with a spaced apart support structure having fixed contact surfaces configured to be engaged by the well casing, and with a fixed leg structure having at least a portion which extends outwardly at an angle away from the center axis of the wellhead casing, the wellhead casing extending through the suction foundation.

19. The device according to claim 18, wherein the supporting frame includes a well casing extension which is positioned on top of and at least partially around the upper portion of the well casing, and is configured to be engaged by the fixed contact surfaces of the support structure.

20. The device according to claim 19, wherein the wellhead element is configured to be positioned on top of and at least partially around an upper end of the upper portion of the well casing or an upper end of the well casing extension.

21. A device for reducing the load on a subsea wellhead casing from a bending moment generated by a horizontal load component from at least a Christmas tree that includes a blowout preventer, the Christmas tree being connected to the wellhead casing, wherein a supporting frame is connected to an upper portion of the wellhead casing and projects outwards from the center axis of the wellhead casing and is provided with abutments which rest supportingly against a base in the form of a suction foundation and at a radial distance from the wellhead casing, the supporting frame being configured to absorb a portion of the bending moment, the wellhead casing extending through the suction foundation.

* * * * *